US010440780B2

(12) United States Patent
Ouellet

(10) Patent No.: US 10,440,780 B2
(45) Date of Patent: Oct. 8, 2019

(54) HEATING COIL FOR A PLUMBING VENT

(71) Applicant: Sylvain Ouellet, Saguenay (CA)

(72) Inventor: Sylvain Ouellet, Saguenay (CA)

( * ) Notice: Subject to any disclaimer, the term of this patent is extended or adjusted under 35 U.S.C. 154(b) by 0 days.

(21) Appl. No.: 16/040,866

(22) Filed: Jul. 20, 2018

(65) Prior Publication Data

US 2019/0053333 A1 Feb. 14, 2019

(30) Foreign Application Priority Data

Aug. 8, 2017 (GB) ..... 1712684.8

(51) Int. Cl.

| | |
|---|---|
| ***H05B 3/46*** | (2006.01) |
| ***F23J 13/02*** | (2006.01) |
| ***H05B 3/50*** | (2006.01) |
| ***H05B 3/58*** | (2006.01) |

(52) U.S. Cl.

CPC ..... *H05B 3/46* (2013.01); *F23J 13/025* (2013.01); *H05B 3/50* (2013.01); *H05B 3/58* (2013.01); *F23J 2900/13006* (2013.01)

(58) Field of Classification Search

CPC ..... H05B 3/46; H05B 3/50; H05B 3/58; F23J 13/025; F23J 2213/40; F23J 2900/13006

See application file for complete search history.

(56) References Cited

U.S. PATENT DOCUMENTS

| | | | | |
|---|---|---|---|---|
| 1,260,564 | A | 3/1918 | Magnusson et al. | |
| 3,275,803 | A | 9/1966 | True | |
| 3,378,673 | A | 4/1968 | Hopper | |
| 4,524,262 | A * | 6/1985 | Meyer | E03F 5/08 137/297 |
| 5,214,266 | A * | 5/1993 | Halone, Jr. | E03C 1/122 219/201 |
| 5,862,303 | A | 1/1999 | Adar et al. | |
| 6,097,008 | A * | 8/2000 | Mahin | E03C 1/122 219/523 |
| 7,220,947 | B2 | 5/2007 | Cardenas et al. | |
| 2007/0207718 | A1* | 9/2007 | Heise | E03C 1/12 454/43 |
| 2008/0164009 | A1 | 7/2008 | Chong | |
| 2009/0145852 | A1 | 6/2009 | Norgaard | |

* cited by examiner

*Primary Examiner* — Ryan A Reis

(57) ABSTRACT

A heating coil for a plumbing vent is provided to melt snow and ice keeping the plumbing vent clear. The heating coil assembly comprises a hollow cylinder with a helicoid heating element, the cylinder configured to fit inside the plumbing vent. The assembly further comprises at least one bracket configured to fasten the cylinder and retain the helicoid heating element inside and above the cylinder. The heating coil is configured to melt snow and ice keeping the plumbing vent clear.

6 Claims, 5 Drawing Sheets

22
30
44
10
14
24

HEATING COIL FOR A PLUMBING VENT

CROSS-REFERENCE TO RELATED APPLICATIONS

The present application claims priority to United Kingdom Patent Application serial number 1712684.8, filed on Aug. 8, 2017 entitled "heating coil for a plumbing vent", the disclosure of which is hereby incorporated in its entirety at least by reference.

BACKGROUND OF THE INVENTION

1. Field of the Invention

The present invention relates generally to heating elements but more particularly to a heating coil for a plumbing vent.

2. Description of Related Art

Plumbing vents on rooftops often become clogged by ice and snow which prevents them from working properly. Also, when the vents are clogged it traps bad odors which may flow back into the house, leading to a very unpleasant situation. Currently, except for removing ice and snow, or waiting for spring, there are no current solutions to this problem. Consequently, there is a need for a heating coil for a plumbing vent providing a solution to the aforementioned problems.

BRIEF SUMMARY OF THE INVENTION

In one embodiment of the present invention a heating coil for a plumbing vent is provide, comprising a hollow cylinder including a rim, a bottom portion, and at least one channel, the hollow cylinder configured to fit inside the plumbing vent; at least one bracket including an external hook, an upper collar, a lower collar, a clip, and a positional portion, the lower collar configured to enter the at least one channel at the rim of the hollow cylinder, and the clip configured to fasten to the bottom portion of the hollow cylinder; and an electric heating element shaped in the form of a helicoid having a number of coil turns, the electric heating element having an upper portion and a main portion, the upper portion positioned between the external hook and upper collar, the main portion configured to be held by the positional portion inside the hollow cylinder, wherein the heating coil is configured to melt snow and ice keeping the plumbing vent clear.

In one embodiment, the positional portion includes a number of positional members configured to guide and position the coil turns of the heating element inside the hollow cylinder. In another embodiment, the electric heating element includes a tip portion bent and positioned towards a center portion of the hollow cylinder. In one embodiment, the upper portion is secured above the rim of the hollow cylinder and configured to melt snow and ice above the plumbing vent. In yet another embodiment, the upper portion includes a length of wire extending along an outside portion of plumbing vent through a base roof member so that the electrical heating element may be connected to an electrical outlet. In one embodiment, the at least one bracket is three brackets.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a heating coil for a plumbing vent.

Figure 1:
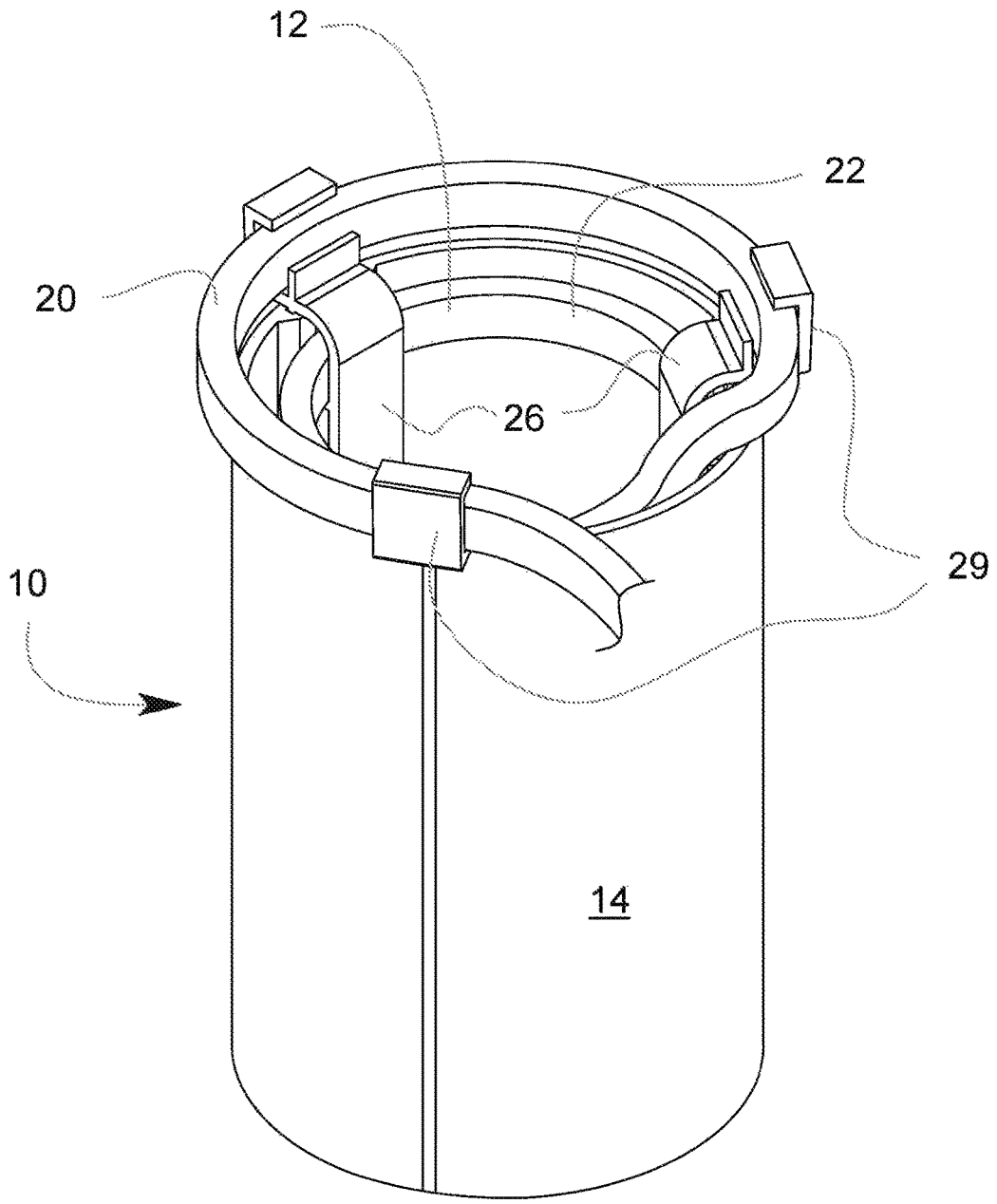
FIG. 1 is an isometric view of a heating coil for a plumbing vent according to an embodiment of the present invention.
Figures 2A, 2B:
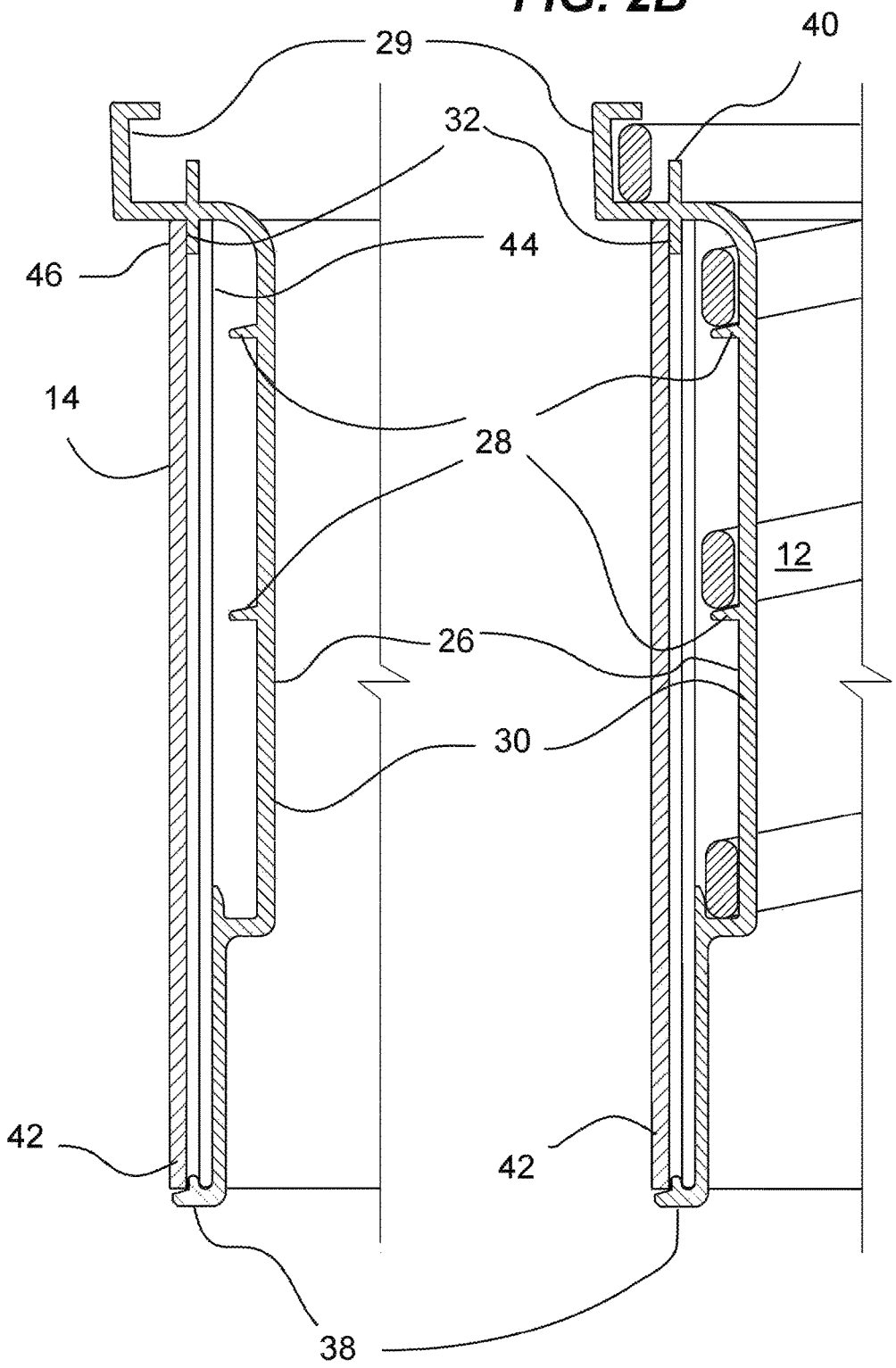
FIGS. 2A-B are section views of a bracket member without and with a heating element respectively according to an embodiment of the present invention.
Figure 3:
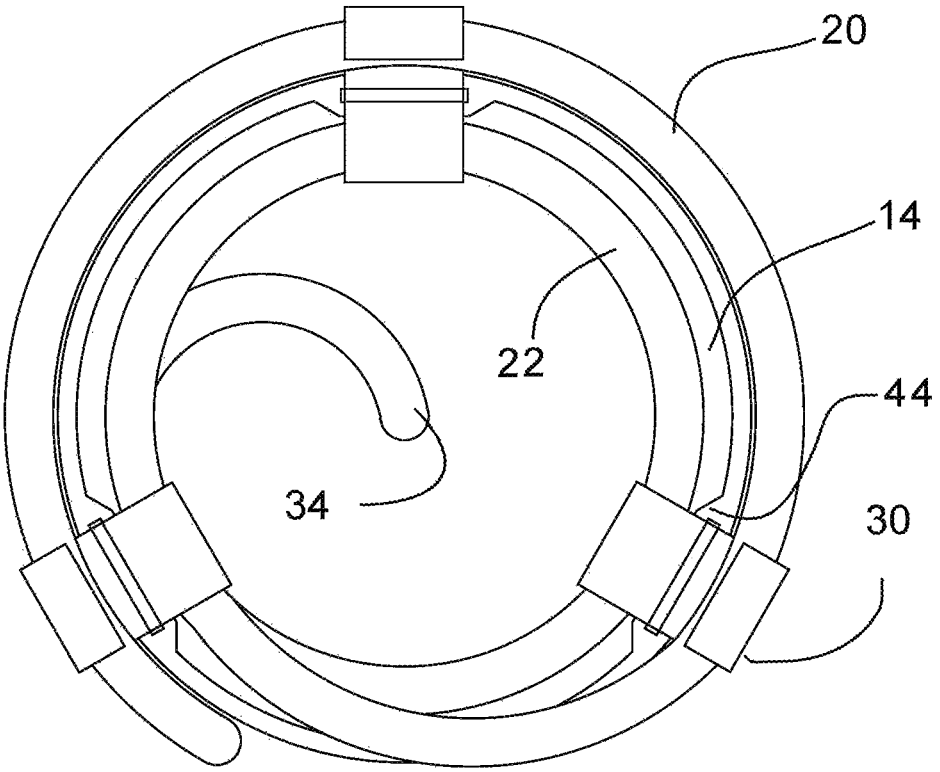
FIG. 3 is a top view of a heating coil for a plumbing vent according to an embodiment of the present invention.
Figure 4:
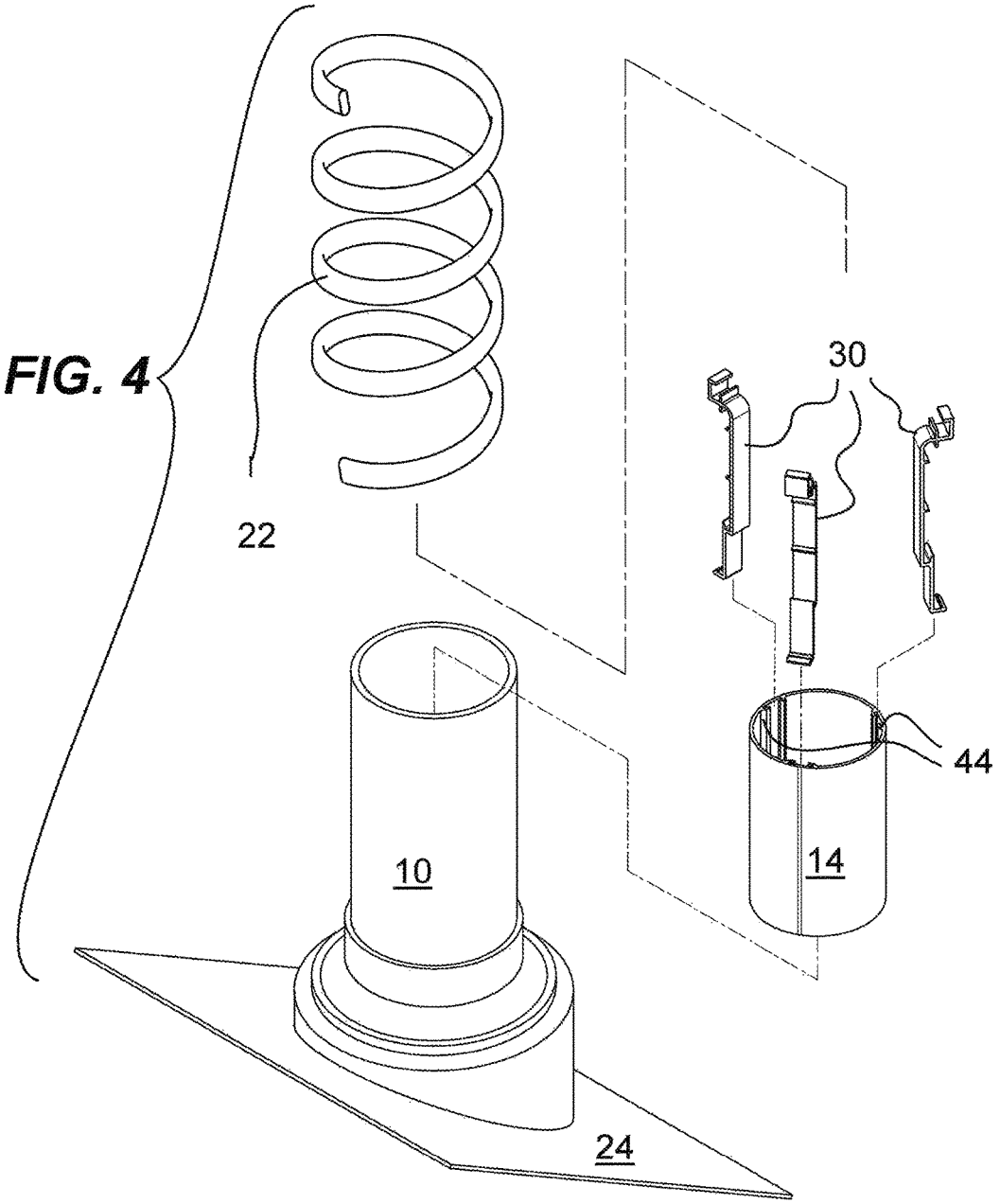
FIG. 4 is an exploded view of the heating coil and plumbing vent according to an embodiment of the present invention; and, FIG. 5 is an isometric view of the heating coil and plumbing vent in context according to an embodiment of the present invention.
Figure 5:
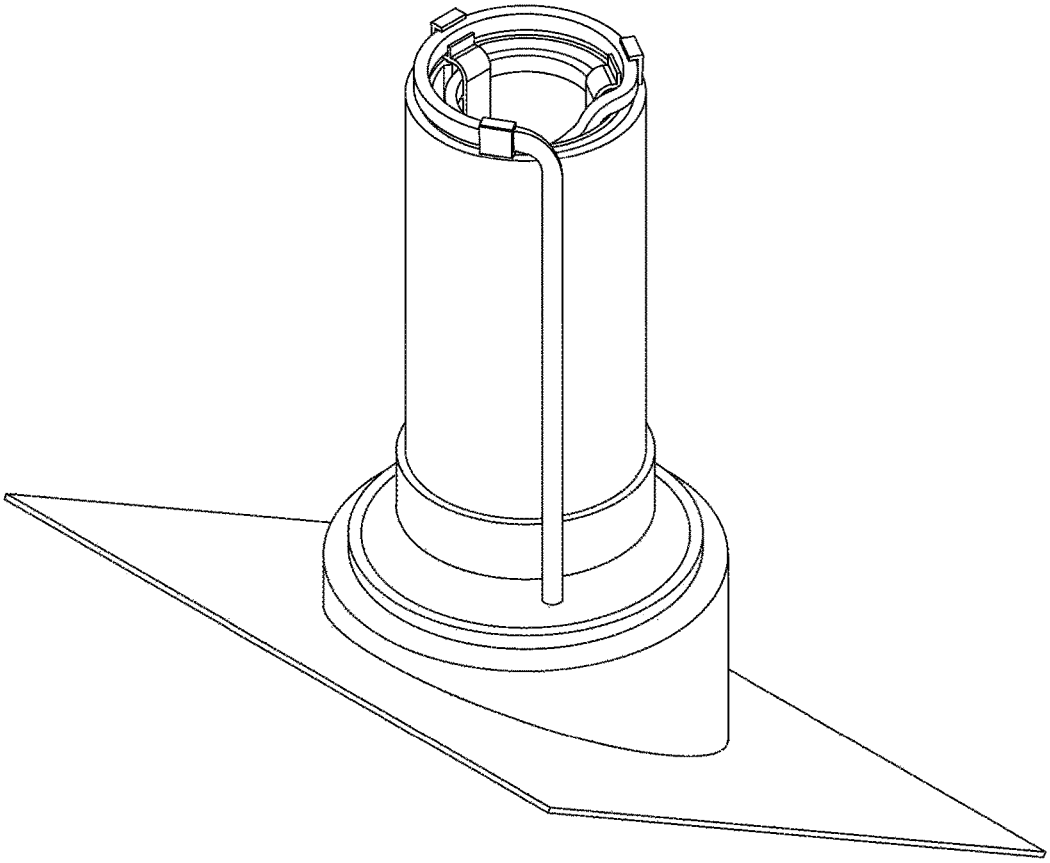

Referring now to any of the accompanying FIGS. 1-5, the present invention comprises a hollow cylinder 14, brackets 30, and electric heating element 12. In one embodiment, the cylinder is configured to fit inside plumbing vent 10. The electric heating element is constructed and formed as a helicoid and is positioned inside the cylinder via the brackets. Preferably, three brackets are provided, however it is understood that the number of brackets may vary. In one embodiment, the electric heating element includes an upper portion 20, a main portion 22, and a tip portion 34. The portions and details of the electric heating element will be described in greater detail below.

In one embodiment, each bracket includes an external hook 29, an upper collar 40, a lower collar 32, a clip 38, and a positional portion 26 having a number of positional members 28. In one embodiment, the clip is configured to fasten to a bottom portion 42 of the cylinder. In one embodiment, the cylinder comprises a number of channels 44 configured to accept the brackets, wherein the lower collars of each bracket are positioned in the channels at the rim 46 of the cylinder. The combination of the clip and lower collar secure the bracket to the cylinder. In one embodiment, the combination of the upper collar and external hook guide the upper portion of the heating element above the rim of the cylinder. In one embodiment, the upper portion includes a length of wire extending along the top and outside of the cylinder and vent through a base member 24 (FIG. 4) so that it may be connected to an electrical outlet. The base member is the interface between the external environment above the roof and the internal environment below the roof, as well known in the art. The positional members are configured to guide and position the coil turns of the heating element inside the cylinder (best seen in FIG. 2B).

During use, the heating element is configured to advantageously keep the vent clear of snow and ice by being set to a predetermined temperature such that the snow and/or ice melts when in proximity to the vent. A main portion 22 of the heating element inside the cylinder is configured to melt any snow and/or ice present inside the cylinder/vent. Since the upper portion of the heating element extends above the top of the vent, melted ice (water) flows inside the vent clearing any packed snow around the vent. As snow and ice turn to water, the water follows the path of the coiled heating element, warming the water and thereby helping melt snow and ice both inside and outside of the vent. In one embodiment, a tip portion 34 (best seen in FIG. 3) of the heating element is bent and positioned towards the center of the cylinder to break and melt any potential ice formation that could potentially block the cylinder and vent. Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A heating coil for a plumbing vent comprising:

a hollow cylinder including a rim, a bottom portion, and at least one channel, the hollow cylinder configured to fit inside the plumbing vent;

at least one bracket including an external hook, an upper collar, a lower collar, a clip, and a positional portion, the lower collar configured to enter the at least one channel at the rim of the hollow cylinder, and the clip configured to fasten to the bottom portion of the hollow cylinder; and an electric heating element shaped in the form of a helicoid having a number of coil turns, the electric heating element having an upper portion and a main portion, the upper portion positioned between the external hook and upper collar, the main portion configured to be held by the positional portion inside the hollow cylinder, wherein the heating coil is configured to melt snow and ice keeping the plumbing vent clear.

2. The heating coil for a plumbing vent of claim 1, wherein the positional portion includes a number of positional members configured to guide and position the coil turns of the heating element inside the hollow cylinder.

3. The heating coil for a plumbing vent of claim 1, wherein the electric heating element includes a tip portion bent and positioned towards a center portion of the hollow cylinder.

4. The heating coil for a plumbing vent of claim 1, wherein the upper portion is secured above the rim of the hollow cylinder and configured to melt snow and ice above the plumbing vent.

5. The heating coil for a plumbing vent of claim 4, the upper portion includes a length of wire extending along an outside portion of plumbing vent through a base roof member so that the electrical heating element may be connected to an electrical outlet.

6. The heating coil for a plumbing vent of claim 1, wherein the at least one bracket is three brackets.

* * * * *